US009780496B2

(12) United States Patent
Guo et al.

(10) Patent No.: US 9,780,496 B2
(45) Date of Patent: Oct. 3, 2017

(54) ELECTRICAL CONNECTOR HAVING IMPROVED CONTACT MODULE AND METHOD FOR MAKING SAME

(71) Applicant: FOXCONN INTERCONNECT TECHNOLOGY LIMITED, Grand Cayman (KY)

(72) Inventors: Jing-Jie Guo, Huaian (CN); Jun Zhao, Huaian (CN); Cai-Yun Zhang, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/348,928

(22) Filed: Nov. 10, 2016

(65) Prior Publication Data

US 2017/0133797 A1 May 11, 2017

(30) Foreign Application Priority Data

Nov. 10, 2015 (CN) ..... 2015 1 0758616

(51) Int. Cl.

| | |
|---|---|
| ***H01R 9/24*** | (2006.01) |
| ***H01R 13/02*** | (2006.01) |
| ***H01R 13/6585*** | (2011.01) |
| ***H01R 24/62*** | (2011.01) |
| ***H01R 13/405*** | (2006.01) |
| *H01R 107/00* | (2006.01) |

(52) U.S. Cl.

CPC ..... *H01R 13/6585* (2013.01); *H01R 13/405* (2013.01); *H01R 24/62* (2013.01); *H01R 2107/00* (2013.01)

(58) Field of Classification Search

CPC ..... H01R 9/09; H01R 43/16; H01R 43/24; H01R 43/20

USPC ..... 439/885; 29/884

See application file for complete search history.

(56) References Cited

U.S. PATENT DOCUMENTS 7,621,788 B1 * 11/2009 Feng ..... H01R 43/16 439/885

8,118,625 B2 * 2/2012 Tsai ..... H01R 43/16 439/885

(Continued)

FOREIGN PATENT DOCUMENTS

| | | |
|---|---|---|
| CN | 203859275 | 10/2014 |
| CN | 203932381 | 11/2014 |
| CN | 104466592 | 3/2015 |

*Primary Examiner* — Abdullah Riyami
*Assistant Examiner* — Thang Nguyen
(74) *Attorney, Agent, or Firm* — Wei Te Chung; Ming Chieh Chang

(57) ABSTRACT

An electrical connector includes an insulative housing having a tongue portion, a shielding plate, a first contact assembly and a second contact assembly accommodated to the insulative housing. The first contact assembly and the second contact assembly include a number of first contacts and second contacts respectively. The first contacts include a number of outer contacts and a number of inner contacts. Each first contact includes a head portion. There are an outer secondary belting connecting the head portions of the outer contacts together and an inner secondary belting connecting the head portions of the inside contacts together. The outer secondary belting and the inner secondary belting are separated from each other.

18 Claims, 15 Drawing Sheets

(56) References Cited

U.S. PATENT DOCUMENTS

| | | | | |
|---|---|---|---|---|
| 8,894,451 | B2 * | 11/2014 | Shiratori | H01R 13/6471 439/660 |
| 9,231,356 | B1 * | 1/2016 | Ju | H01R 24/78 |
| 9,577,373 | B2 * | 2/2017 | Kato | H01R 13/6275 |
| 2011/0065338 | A1 * | 3/2011 | Zhang | H01R 43/16 439/862 |
| 2014/0345134 | A1 * | 11/2014 | Zebhauser | H01R 43/16 29/884 |
| 2016/0359274 | A1 * | 12/2016 | Zhang | H01R 43/24 |
| 2017/0117673 | A1 * | 4/2017 | Zhang | H01R 24/60 |

* cited by examiner

10

10

10

ELECTRICAL CONNECTOR HAVING IMPROVED CONTACT MODULE AND METHOD FOR MAKING SAME

BACKGROUND OF THE INVENTION

1. Field of the Invention

The present invention relates generally to an electrical connector, and more particularly to an electrical connector adapted for normally and reversely mating with a mating connector and a method of making the same.

2. Description of Related Arts

China Patent No. 104466592, issued on Mar. 25, 2015, discloses a method of making an electrical connector, comprising the steps of: providing a row of first terminals, molding an insulating block on the first terminals to form a first terminal module; providing a middle shielding sheet; insert molding an insulating body with the middle shielding sheet and the first terminal module; providing a row of second terminals and molding an insulating member on the second terminals to form a second terminal module; and assembling the second terminal module to the insulating body.

An improved electrical connector is desired.

SUMMARY OF THE INVENTION

An object of the present invention is to provide an electrical connector which is easy to make.

To achieve the above-mentioned object, an electrical connector includes: an insulative housing having a tongue portion; a shielding plate; a first contact assembly and a second contact assembly accommodated to the insulative housing, the first contact assembly having a number of first contacts, the second contact assembly having a number of second contacts, the first contacts having a number of outer contacts and a number of inner contacts, each first contact having a head portion; wherein there are an outer secondary belting connecting the head portions of the outer contacts together and an inner secondary belting connecting the head portions of the inside contacts together, and the outer secondary belting and the inner secondary belting are separated from each other.

Other objects, advantages and novel features of the invention will become more apparent from the following detailed description when taken in conjunction with the accompanying drawings.

DETAILED DESCRIPTION OF THE PREFERRED EMBODIMENT

Figure 1:
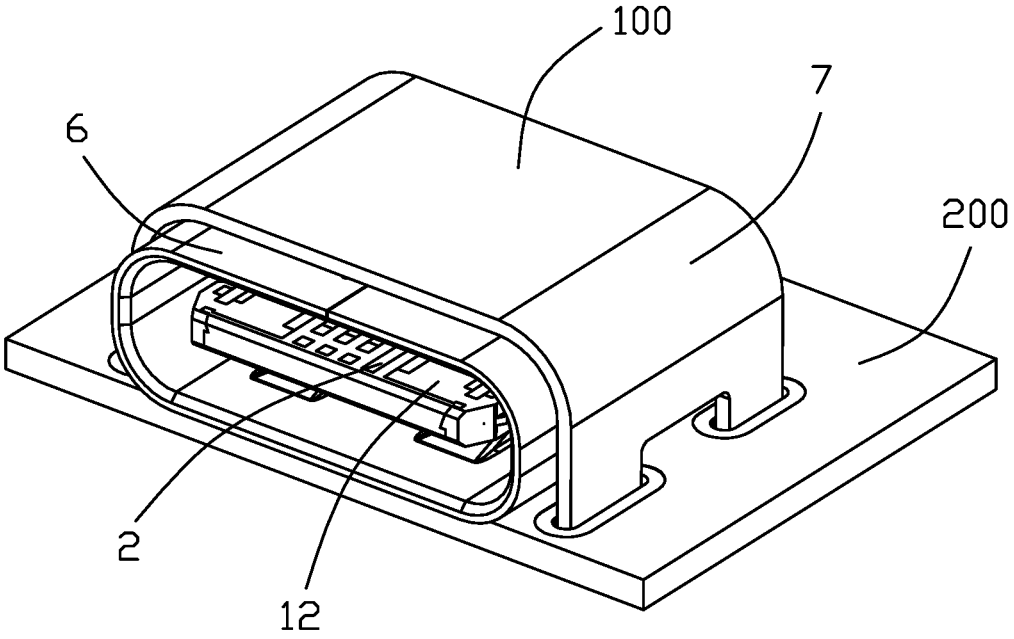
FIG. 1 is a perspective, assembled view of an electrical connector and a printed circuit board in accordance with the present invention.
Figure 2:
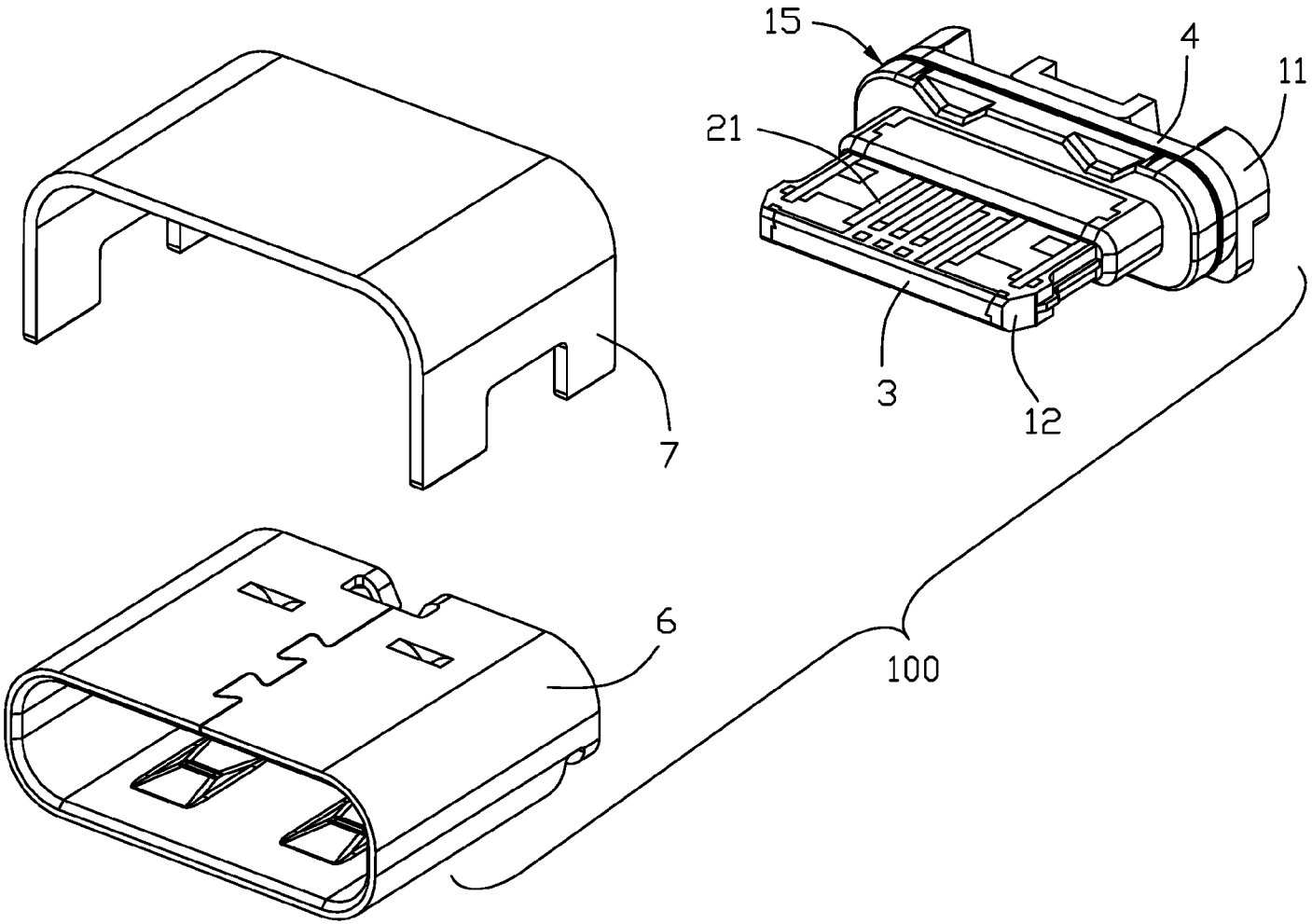
FIG. 2 is a perspective, partially exposed view of the electrical connector shown in FIG. 1.

Referring to FIGS. 1-9(B), the electrical connector 100 assembled to a printed circuit board 200 in accordance with the present invention, comprises an insulative housing 1, a first contact assembly and a second contact assembly accommodated in the insulative housing 1, a shielding plate 5 connecting with a shielding belting 51, an insulative module or filling structure 3, a seal member 4, and an inner shell 6 and an outer shell 7 attached to the insulative housing 1.

The insulative housing 1 comprises a base portion 11 and a tongue portion 12. The first contact assembly comprises a row of first contacts 22, an outer/first group secondary belting 223 and an inner/second group secondary belting 224. The first contacts 22 comprise four outer contacts 221 as a group and three inner contacts 222 between the four outer contacts 221 as another group. The four outer contacts 221 are located at two sides of the three inner contacts 222 symmetrically. Each first contact 22 comprises a head portion 225, a contacting section 226 extending backwardly from the head portion 225, a soldering portion 227 located at a rear end thereof and a connecting portion 228 connecting the contacting section 226 and the soldering portion 227. The first contact further comprises a pair of ear portions 2261 extending outwardly from two sides of the contacting section 226. The second contact assembly comprises a row of second contacts 21. Each second contact comprises a front section 211, a soldering section 212 and a middle section 213 connecting the front section 211 and the soldering section 212.

Figure 5:
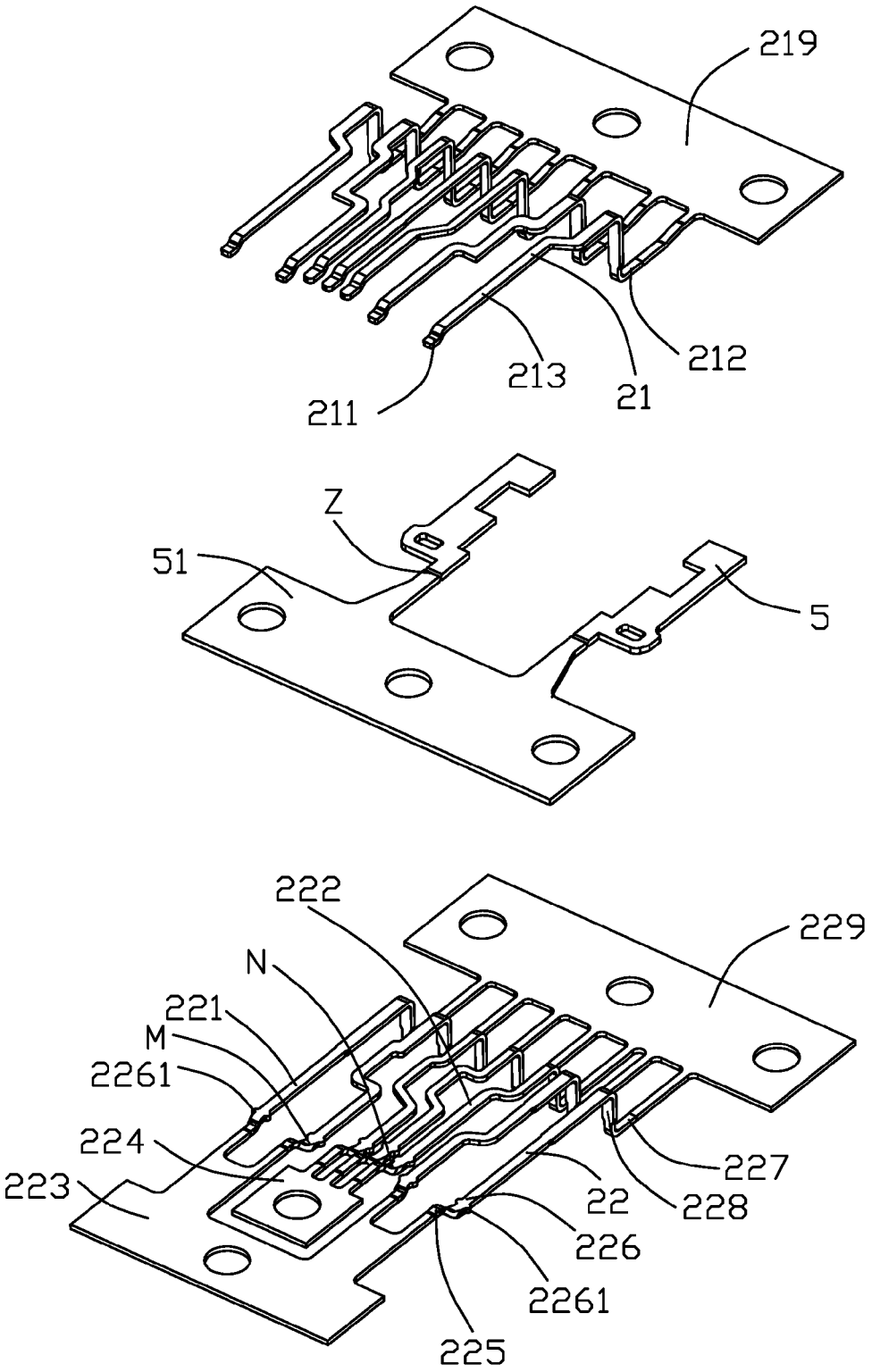
FIG. 5 is an exploded view of the first contact assembly, the second contact assembly and a shielding plate without showing the bridges between the adjacent two contacts of FIG. 4.

The steps of making the electrical connector 100 are as follows. Step 1: stamping to form four outer contacts 221, three inner contacts 222 and a row of second contacts 21. In the step of stamping, the four outer contacts 221 are connected with the outer secondary belting or carrier 223 at a first position X of the head portion 225. The three inner contacts 222 are connected with the inner secondary belting 224 at a second position Y of the head portion 225. The first position X and the second position Y are located in a same line. Referring to FIG. 5, a rear end of the first contacts 22 is connected with a first primary belting or carrier 229, and a rear end of the second contacts 21 is connected with a second primary belting or carrier 219. The shielding plate 5 connects with the shielding belting or carrier 51 at a third portion Z.

Referring to FIG. 5, the inner secondary belting 224 and the outer secondary belting 223 are separated from each other. The outer secondary belting 223 and the inner secondary belting 224 are coplanar, and the inner secondary belting 224 is inside of the outer secondary belting 223 and is surrounded by the outer secondary belting 223. A first connecting bend M is located between the head portion 225 and the contacting section 226 of the outer contacts 221. A second connecting bend N is located between the head portion 225 and the contacting section 226 of the inner contacts 222. The first connecting bend M is located in front of the second connecting bend N.

The head portion 225 of the first contacts 22 are bent to one side along the horizontal direction so as to be deflected from the front section 211 of the second contacts 21. The head portion 225 of the first contacts 22 and the front section 211 of the second contacts 21 can be supported by a mould. The contacting section 226 of the first contacts 22 and a corresponding mating section 226 of the second contacts 21 are overlapped. The ear portions 2261 of the first contacts 21 can be supported by the mould.

Step 2: insert molding the insulative housing 1, the first contacts 22, the second contacts 21 and the shielding plate 5 connecting with a shielding belting 51 to form a whole contact module 10. In the step of insert molding the insulative housing 1, The head portion 225 of the first contacts 22 and the front section 211 of the second contacts 21 are embedded to the tongue portion 12. The contacting/mating section 226 of the first contacts 22 and a contacting/mating section 213 of the second contacts 21 are exposed out of a lower surface and an upper surface of the tongue portion 12 respectively for mating with a mating connector (not shown). Each contacting section 226 of the first contacts 22 is positioned in reverse symmetry with respect to a respective one of the second contacts 21, so as to achieve the electrical connector 100 adapting for being normally and reversely mating with the mating connector.

Step 3: cutting off the outer secondary belting 223, the inner secondary belting 224 and the shielding belting 51 at the first portion X, the second portion Y and the third portion Z. Step 4: insert molding the insulative module 3 to seal a plurality of holes/spaces (not numbered) formed in the process of insert molding the insulative housing 1. Step 5: cutting off the first primary belting 229 and the second primary belting 219. Step 6: assembling the inner shell 6 and the outer shell 7 to the insulative housing 1. Step 7: sealing a gap division between the insulative housing 1 and the inner shell 6 to form the seal member 4.

In the present invention, the four outer contacts 221 comprises a first grounding contact, a first power contact, a second power contact and a second grounding contact arranged in turn from left to right. The three inner contacts 222 comprises a first signal contact, a second signal contact and a detecting contact arranged in turn from left to right. The head portion 225 of the four outer contacts 221 is farther than the head portion 225 of the three inner contacts 222 so as to achieving a connection electrically earlier during mating. Referring to FIG. 5, the first connecting portion M is located in front of the second connecting portion N. The first connecting portion M and the second connecting portion N are not in a same line, and the inner secondary belting 224 and the outer secondary belting 223 are set apart so as to bend the outer contacts 221 and the inner contacts 222 at different positions. Stamping to form the first contacts 22 in one cut-off process through having the outer secondary belting 223 and the inner secondary belting 224 at the same time. The first contacts 22 and the second contacts 22 can be supported by the mould at the same time so as to achieve insert-molding of the whole contact module one shot.

In brief, one feature of the invention is that because the first connecting portion M and second connecting portion N are located at different positions along the front-to-back direction for complying with the different contacting procedure/time during mating, the outer secondary carrier 223 and the inner secondary carrier 224 can not be unified together as one piece but should be separated from each other for separate forming. Anyhow, in this embodiment because both the first portion X for the outer secondary carrier 223 and the second portion Y for the inner secondary carrier 224 are aligned with each other along the transverse direction, it is allowed to have one cut-off process to simultaneously remove both the outer secondary carrier 223 and the inner secondary carrier 224 after the first insert-molding process to form the contact module 10 and before filling the insulative module 3 into the contact module 10 to form the final contact unit 15. In other words, the separate outer secondary belting 223 and inner secondary belting 224 is one feature of the invention. It is understandable that even though in this embodiment the first contacts 22 are grouped with the inner contacts 222 having the corresponding secondary belting 224, and the outer contacts 221 having the corresponding secondary belting 223, other arrangement may be feasible depending upon on which contacts the connecting portions M and N are located. Therefore, the secondary beltings 223 and 224 may be side by side arranged with each other rather than in an encircling manner in another embodiment or more than two secondary beltings are available either in a side-by-side manner or in a sequential encircling manner. In other words, in the instant invention, the inner contacts 222 may be deemed as the first group contacts and the outer contacts 221 may be deemed as the second group contacts in a broader viewpoint.

Another feature of the invention is to provide such secondary belts 223 and 224 for easing implementation of the so-called three-part insert-molding process. In fact, the instant invention is essentially an improvement to a copending application Ser. No. 15/174,001 filed Jun. 6, 2016 having the same applicant, in which the upper contact assembly, the lower contact assembly and the shielding plate are integrally formed via a "one-shot" initial/first insert-molding process to form the initial contact module which is successively filled by the insulative module to form the final contact unit via another insert-molding process to form the final contact unit. Notably, in the conventional connector design, it is essentially required to have at least two initial insert-molding processes to have the upper contacts, the shielding plate and the lower contacts to be integrally formed together because only the two-part insert-molding method is relatively feasible. It is because the three-part (the upper contacts, the lower contacts and the shielding plate) insert-molding process has its own manufacturing limitations.

Anyhow, because in the instant invention there are totally fourteen contacts compared with ten contacts in the aforementioned application, it is relatively difficult to have all three parts, i.e., the upper contact assembly, the shielding plate and the lower contact assembly, integrally formed within the insulative housing via one shot insert-molding process. It is because, as shown in the aforementioned application, each of the beltings/linkages/bridges, which assists positioning the adjacent contacts without tilting under high pressure during the insert-molding process, is transversely connected between the corresponding two adjacent contacts and is required to be removed after the contact module is formed via the initial insert-molding process, and the more the contacts are provided, the more the beltings/linkages are required. The space among the contacts are not sufficient for the fourteen contacts in the instant invention even though it might be enough for the ten contacts in the aforementioned application. This is the reason why the invention uses additional front secondary carriers 223. 224 to control the positions of the first contacts 22 during the first insert-molding process in place of some linkages/bridges which are originally required to be transversely connected between two adjacent contacts 22.

In other words, using the additional front/secondary beltings 223, 224 to replace the most original transverse linkages/bridges between the two adjacent first contacts 22 is another feature of the invention, disregarding whether the front/second belting 223, 224 are separated from each other or not. It is also noted that in this invention only the first contacts are provided with the front/secondary beltings 223, 224 while the second contacts are not provided with those front/secondary belting. It is because once the first contacts 22 use the secondary belting to replace the transverse linkages/bridges, there are more spaces for the second contacts 21 to use the corresponding transverse linkages/bridges without necessity of such a front/secondary belting. Understandably, it is also optional to provide the second contacts 21 with the front/secondary belting for assisting positioning the neighboring contacts during the initial/first insert-molding process.

Figure 3A:
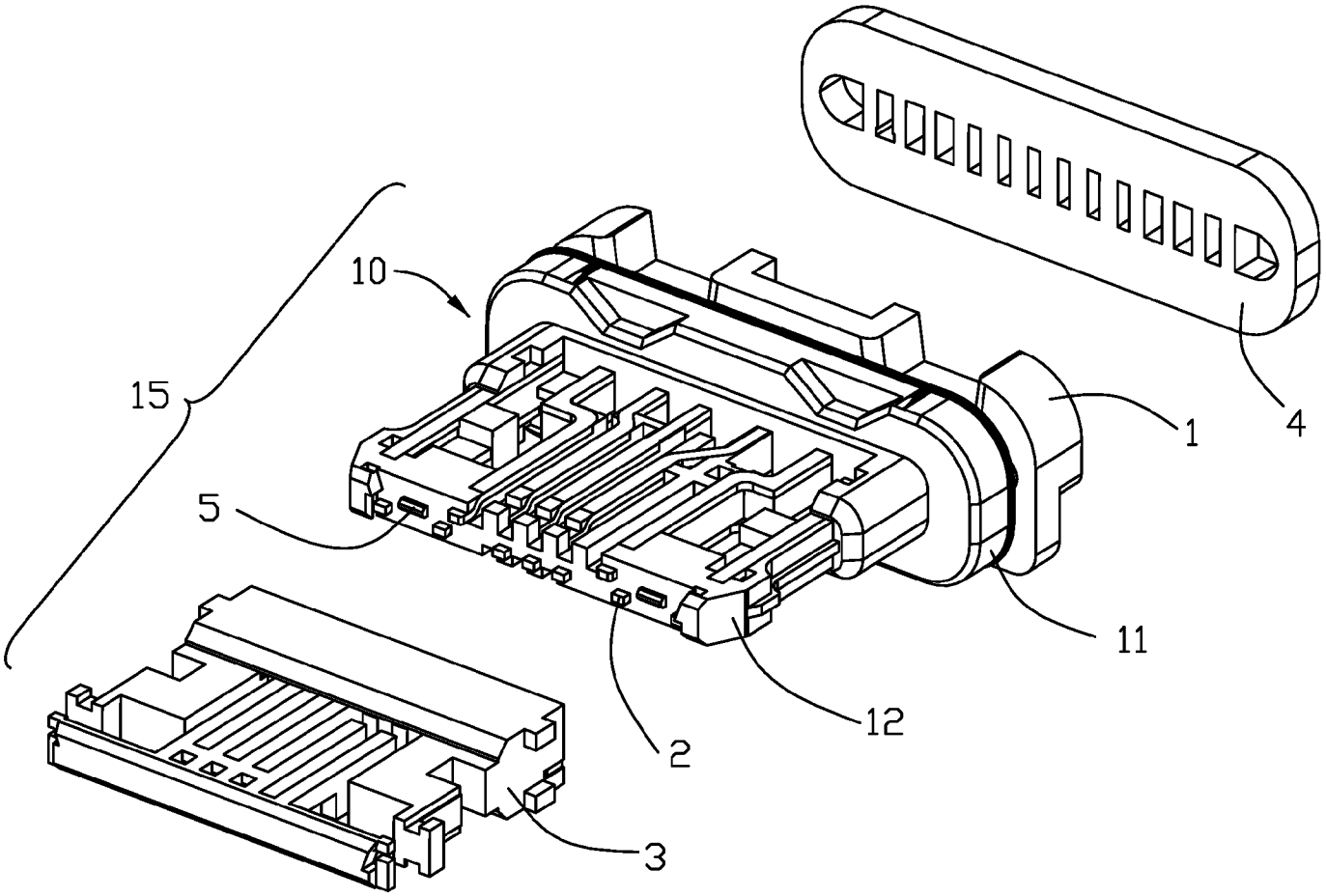
FIG. 3(A) is a downward perspective, partially exploded view of a contact module including the contacts embedded within the insulative housing, and an insulative module adapted to be filled within the insulative housing, and a seal member adapted to be formed behind the insulative housing, of the electrical connector shown in FIG. 2.
Figure 3B:
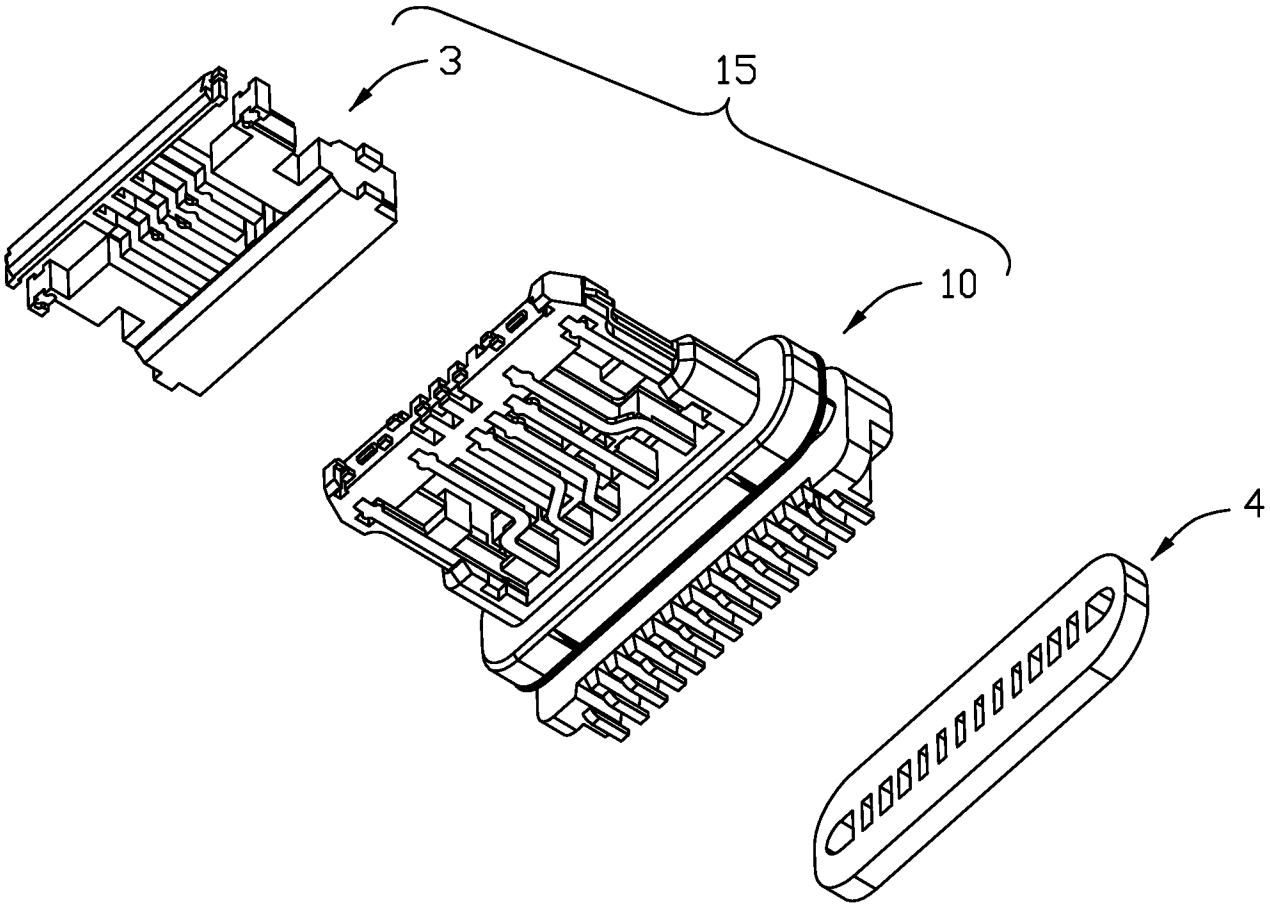
FIG. 3(B) is an upward perspective, partially exploded view of a contact module including the contacts embedded within the insulative housing, and an insulative module adapted to be filled within the insulative housing, and a seal member adapted to be formed behind the insulative housing, of the electrical connector shown in FIG. 2.
Figure 4:
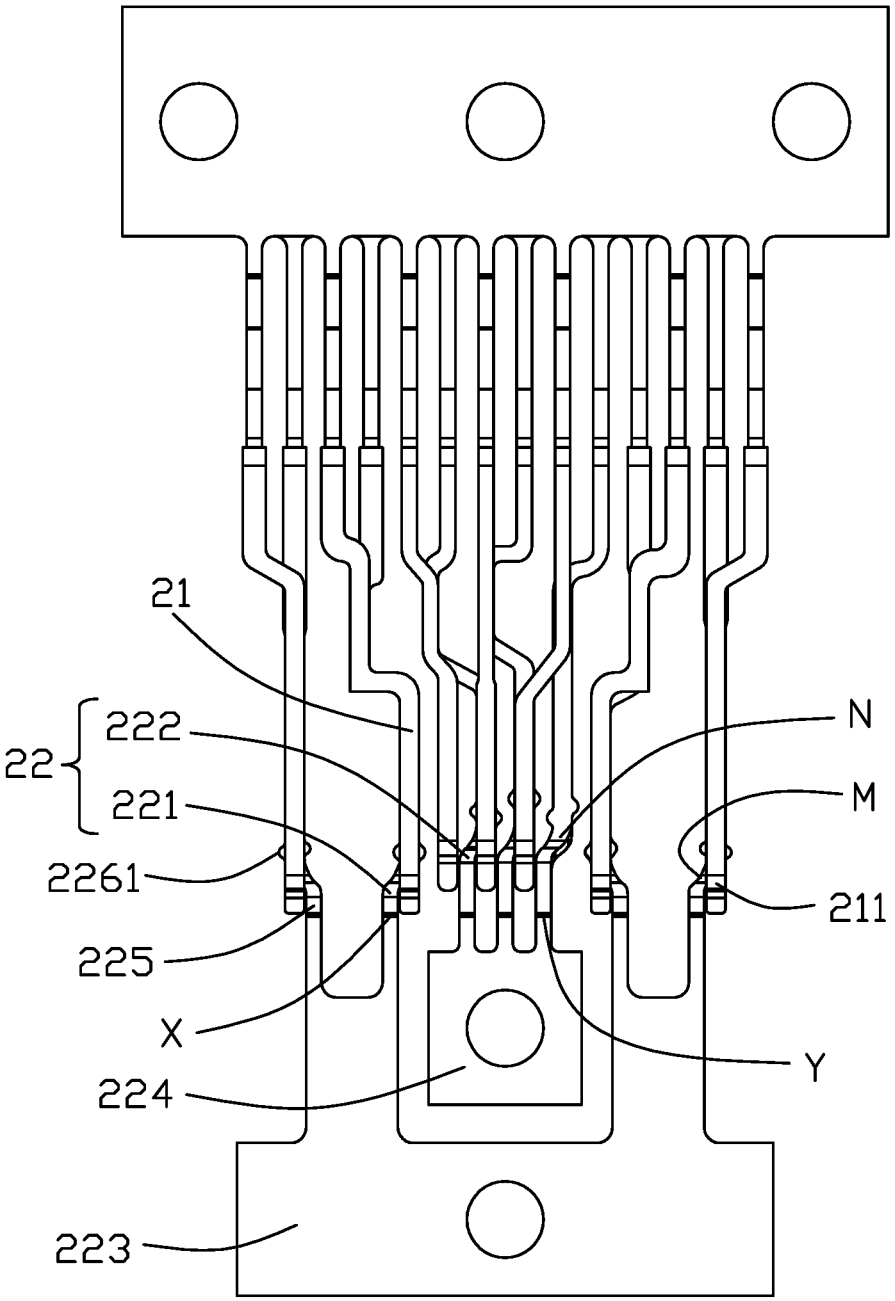
FIG. 4 is a top view of a first contact assembly and a second contact assembly of FIG. 1.
Figure 5A:
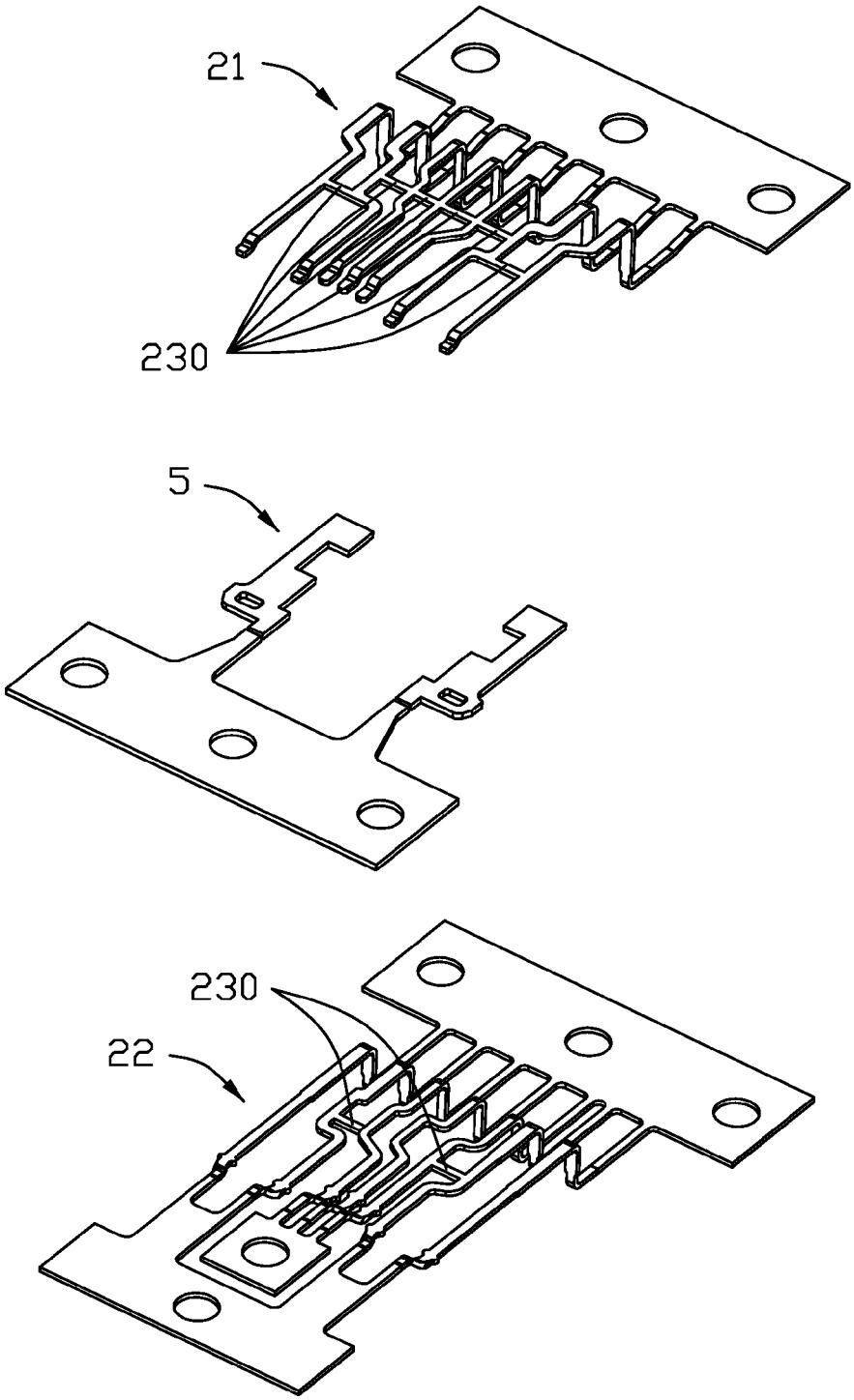
FIG. 5(A) is an exploded view of the first contact assembly, the second contact assembly and a shielding plate with corresponding bridges remaining between the adjacent two contacts of FIG. 4.
Figure 6A:
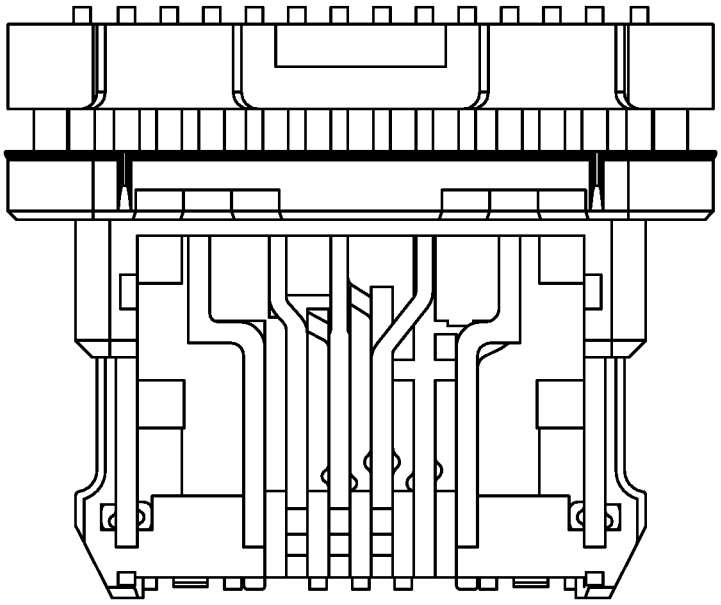
FIG. 6(A) is a top view of the contact module including the contacts insert-molded within the insulative housing while without the insulative module filled therein of the electrical connector of FIG. 1.
Figure 6B:
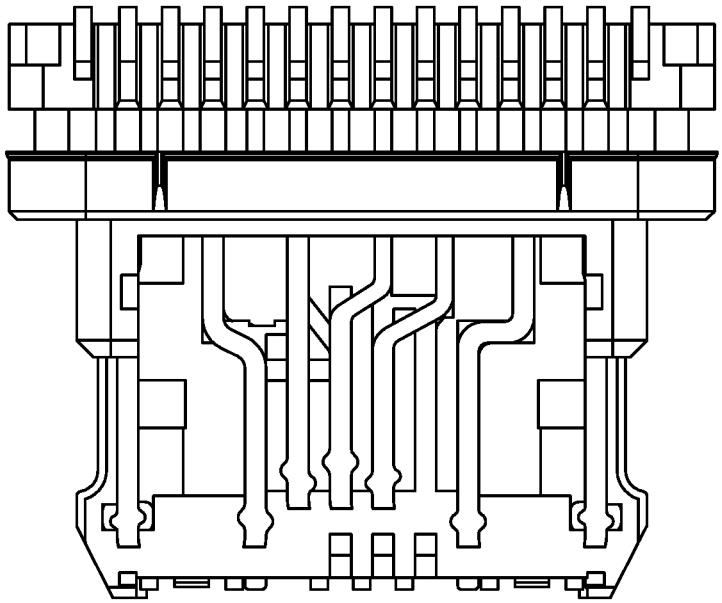
FIG. 6(B) is a bottom view of the contact module including a contacts insert-molded within the insulative housing while without the insulative module filled therein of the electrical connector of FIG. 1.
Figure 7A:
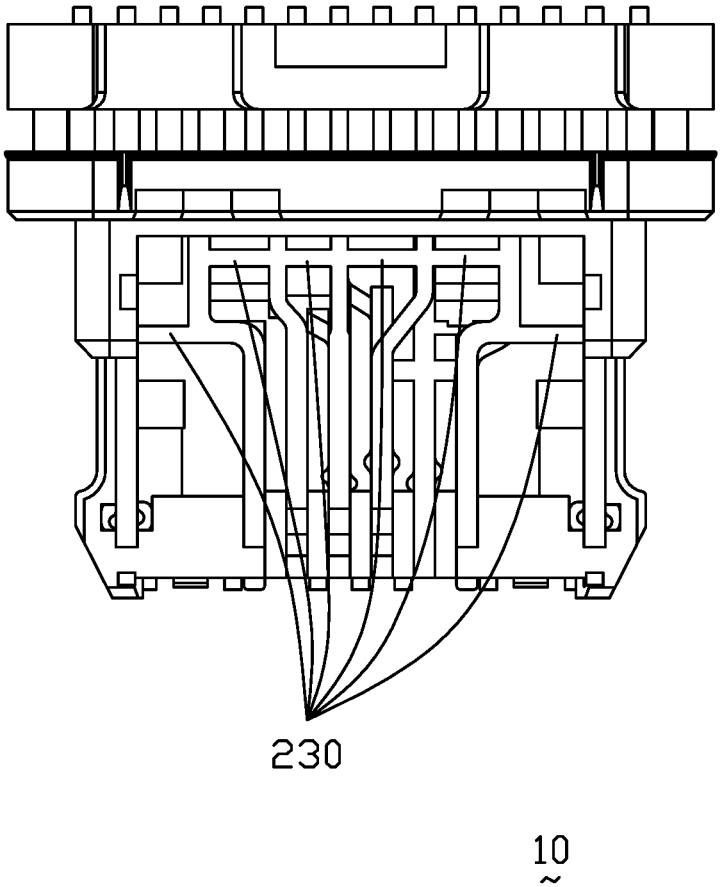
FIG. 7(A) is a top view of the contact module including the contacts insert-molded within the insulative housing with the corresponding bridges attached thereto while without the insulative module filled therein of the electrical connector of FIG. 1.
Figure 7B:
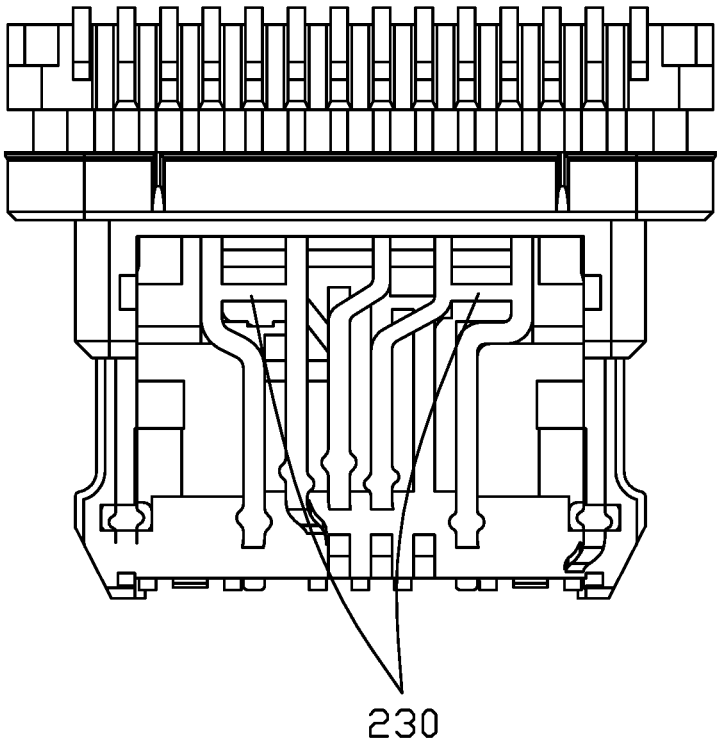
FIG. 7(B) is a bottom view of the contact module including the contacts insert-molded within the insulative housing with the corresponding bridges attached thereto while without the insulative module filled therein of the electrical connector of FIG. 1.
Figure 8A:
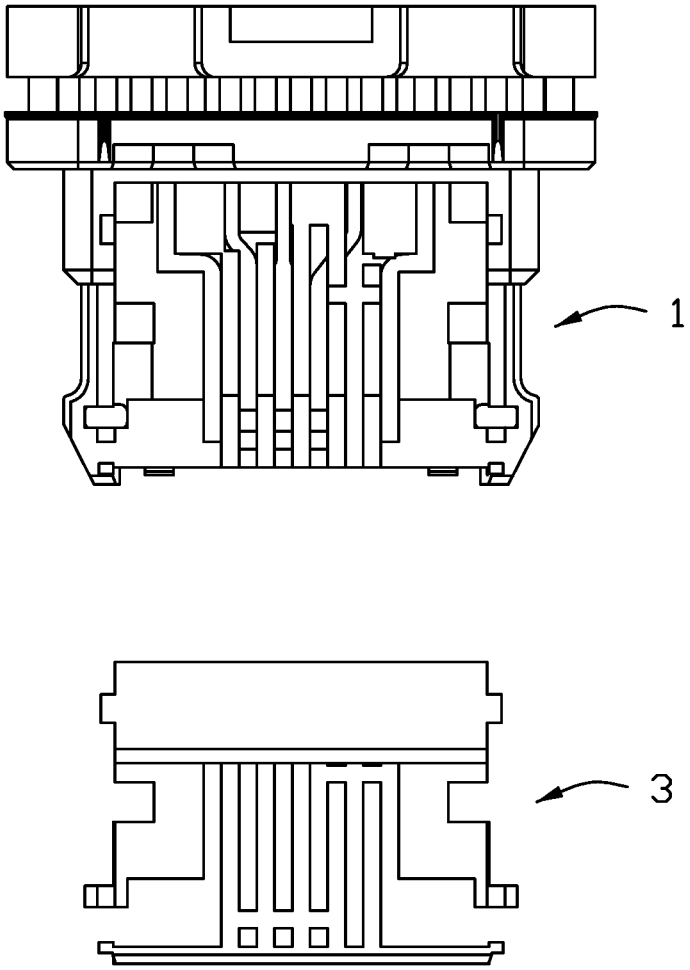
FIG. 8(A) is a top view of the insulative housing and the insulative module separated from each other without therein the corresponding contacts of the electrical connector of FIG. 1.
Figure 8B:
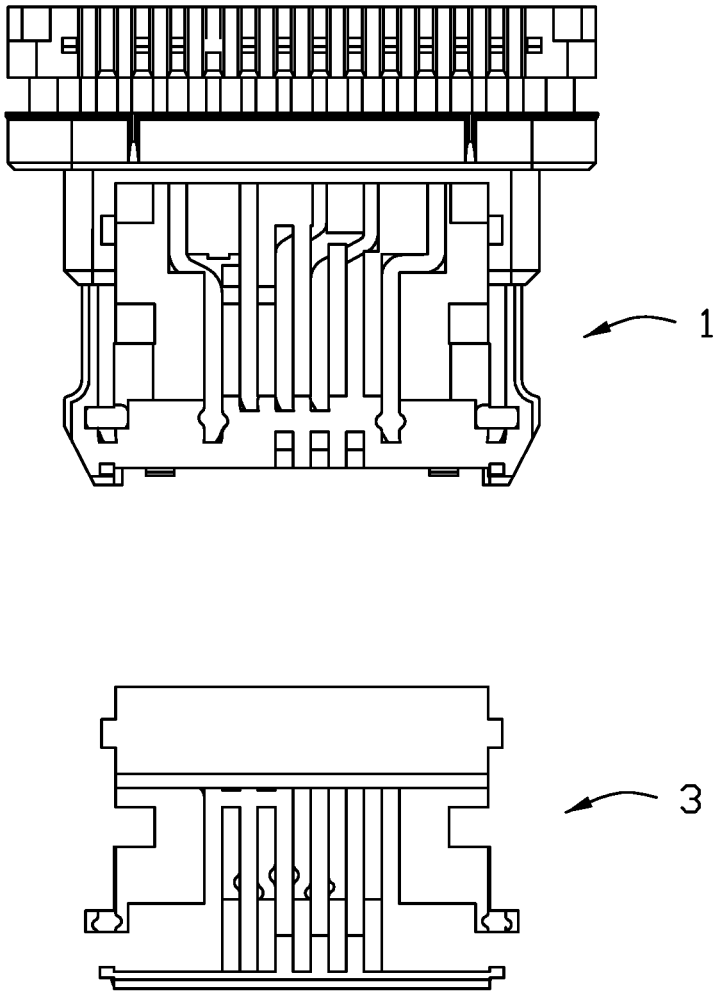
FIG. 8(B) is a bottom view of the insulative housing and the insulative module separated from each other without therein the corresponding contacts of the electrical connector of FIG. 1.
Figure 9A:
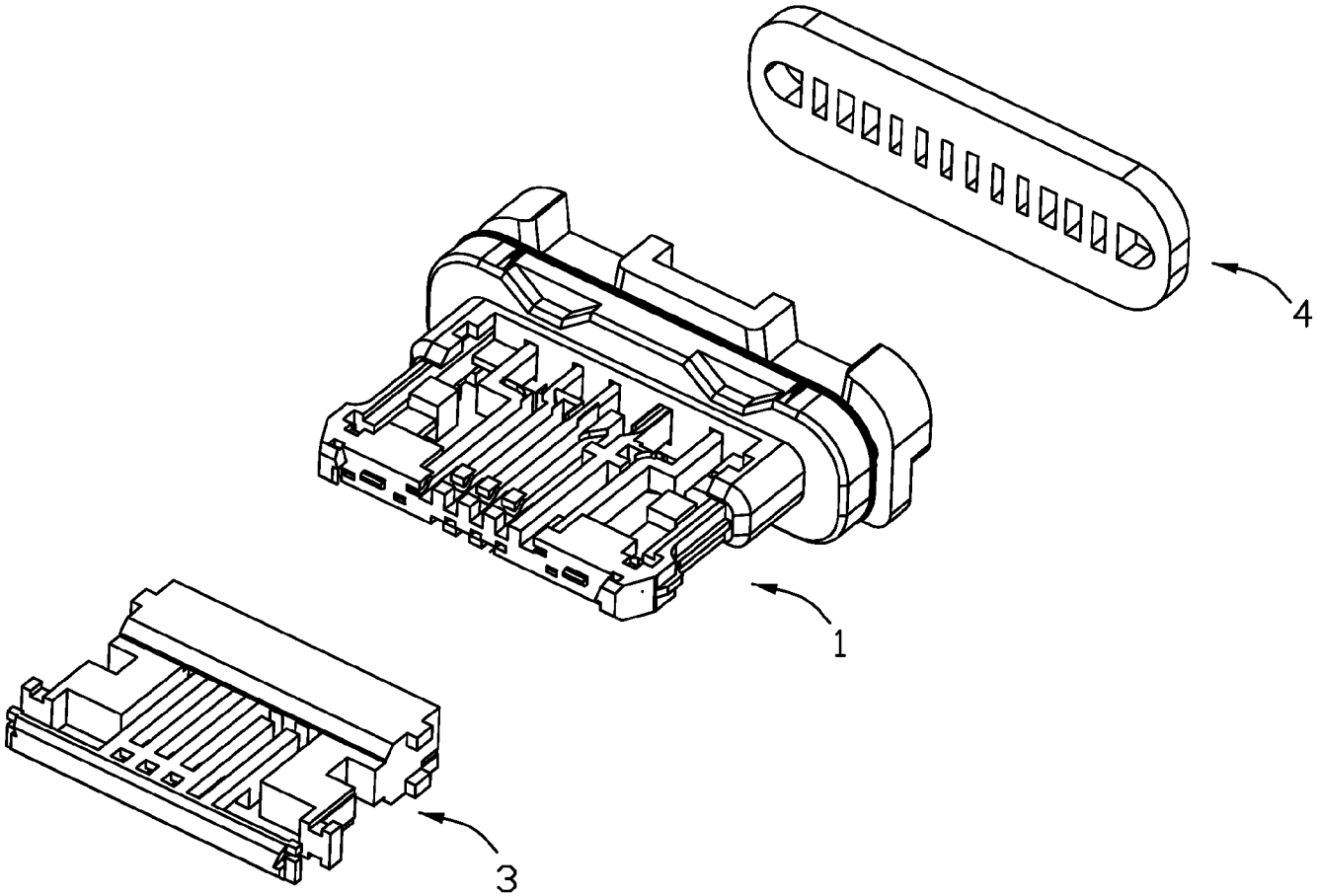
FIG. 9(A) is a downward exploded perspective view of the insulative housing, the insulative module and the seal member without therein the contacts of the electrical connector of FIG. 1.
Figure 9B:
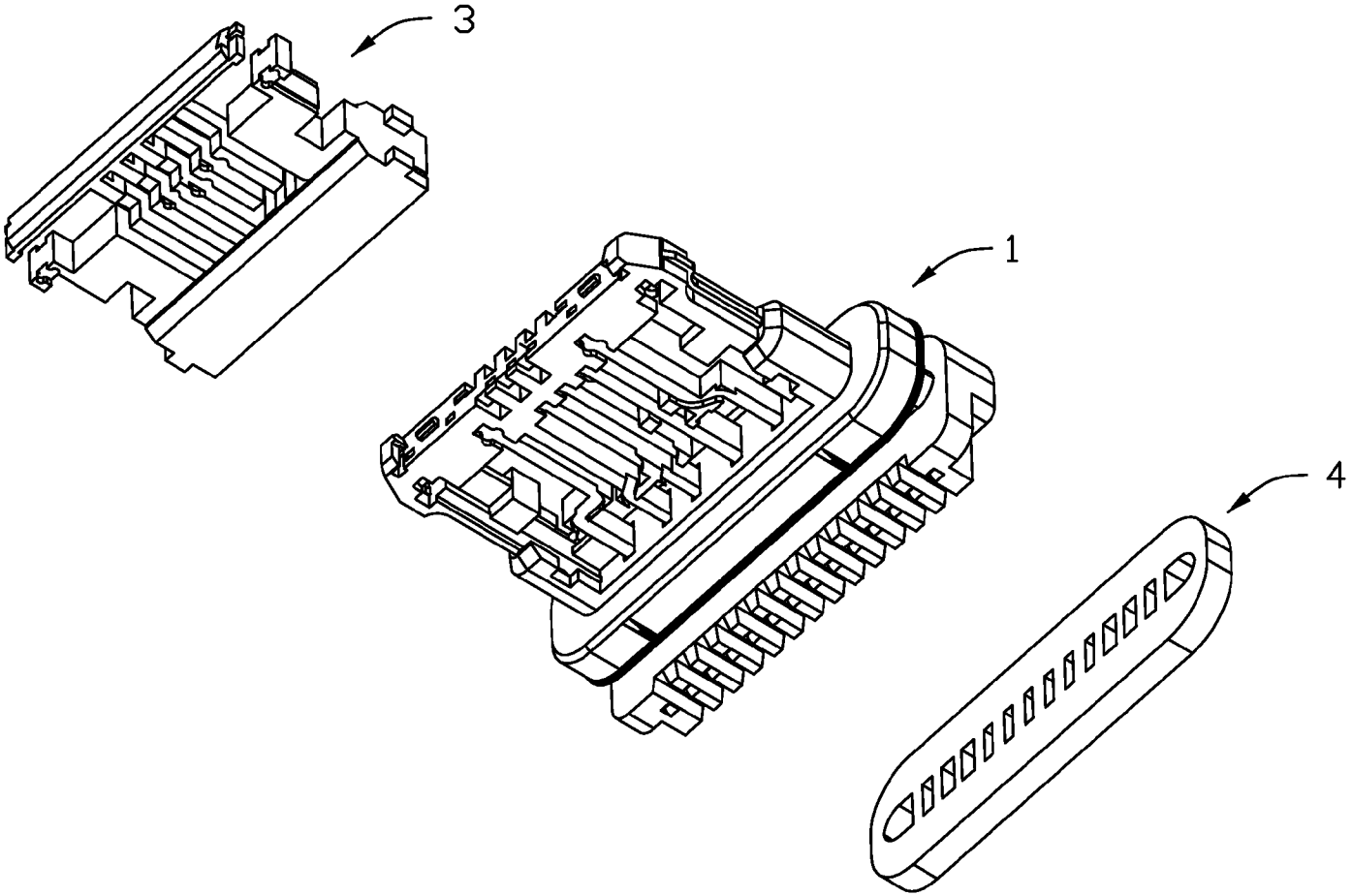
FIG. 9(B) is an upward exploded perspective view of the insulative housing, the insulative module and the seal member without therein the contacts of the electrical connector of FIG. 1.

Comparing FIG. 5(A) with FIG. 5, FIGS. 7(A)/7(B) with FIGS. 6(A)/6(B) and further referring to FIGS. 3(A)/3(B), FIGS. 8(A)/8(B) and FIGS. 9(A)/9(B), it is noted that the transversely extending linkages/bridges 230 between the adjacent two the second contacts 22 and those between the adjacent two first contacts 21 are aligned with the openings/holes/spaces (not labeled) in the insulative housing 1 along the vertical direction for consideration of removal of those linkages/bridges 230 in the vertical direction after the initial insert-molding process to form the contact module 10 and before the insulative module 3 is applied into the contact module 10.

The invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector comprising:

an insulative housing having a tongue portion;

a metallic shielding plate; and a first contact assembly and a second contact assembly accommodated to the insulative housing to have the shielding plate located therebetween in a vertical direction, the first contact assembly comprising a plurality of first contacts, the second contact assembly comprising a plurality of second contacts, the first contacts comprising a plurality of outer contacts and a plurality of inner contacts, each first contact comprising a head portion; wherein there are an outer secondary belting connecting the head portions of the outer contacts together and an inner secondary belting connecting the head portions of the inside contacts together, and the outer secondary belting and the inner secondary belting are separated from each other and adapted to be removed after all said first contact assembly, said second contact assembly and said shielding plate are integrally formed within said housing in an initial insert-molding process and before an insulative module is applied upon said housing for filling spaces in said housing in a successive insert-molding process.

2. The electrical connector as claimed in claim 1, wherein each first contact comprises a contacting section exposed out of the tongue portion, each outer contact and each inner contact comprise a first connecting bend and a second connecting bend connecting the head portion and the contacting section respectively, and the first connecting bend is located in front of the second connecting bend in a front-and-rear direction.

3. The electrical connector as claimed in claim 2, wherein the head portion is embedded to the tongue portion and deflected from the contacting section in a left-to-right direction perpendicular to the front-and-rear direction.

4. The electrical connector as claimed in claim 3, wherein each second contact comprises a front section embedded to the tongue portion and a mating section exposed out of the tongue portion, and the head portion is deflected from the front section in the left-to-right direction.

5. The electrical connector as claimed in claim 4, wherein the mating section and the head portion are overlapped in an up-and-down direction perpendicular to the front-and-rear direction and the left-to-right direction.

6. The electrical connector as claimed in claim 2, wherein the first contact further comprises a pair of ear portions extending from two sides of the contacting section.

7. The electrical connector as claimed in claim 1, wherein the outer secondary belting and the inner secondary belting are coplanar, and the inner secondary belting is inside of the outer secondary belting and is surrounded by the outer secondary belting.

8. A method of making an electrical connector, comprising the steps of:

providing a plurality of first contacts in one row with a first group of contacts connecting with a first group secondary belting linked on front ends of said first group of contacts, and a second group contacts connecting with a second group secondary belting linked on front ends of said second group of contacts, and a plurality of second contacts in another row, the first group secondary belting and the second group secondary belting separated from each other;

providing a metallic shielding plate between said first contacts and said second contacts; and integrally forming the first contacts, the second contacts and a shielding plate within an insulative housing via an initial insert-molding process to form a contact module; wherein the insulative housing has a tongue portion, and each of said first contacts and said second contacts has a contacting section exposed out of the tongue portion for mating;

wherein all said first contacts share a same primary belting on rear ends opposite to said first group secondary belting and said second group secondary belting.

9. The method as claimed in claim 8, further comprising a step of cutting off the first group secondary belting and said second group secondary belting from the contact module.

10. The method as claimed in claim 9, wherein connection portions between the first group secondary belting and the first group of contacts, and those between the second group second belting and the second group of contacts are aligned with each other in a transverse direction so as to allow a single operation to simultaneously remove both said first group secondary belting and said second group secondary belting.

11. The method as claimed in claim 8, further comprising the steps of insert molding an insulative module to seal a plurality of holes formed in the contact module.

12. The method as claimed in claim 8, wherein the first group of contacts are outer contacts and the second group of contacts are inner contacts so as to have the first group of contacts located by two sides of said second group of contacts and have the first group secondary belting enclose the second group secondary belting.

13. The method as claimed in claim 8, further including a step of forming said first contacts with a bending process wherein a bending position of each of said first group of contacts and that of each of said second group of contacts are offset from each other in a front-to-back direction.

14. An electrical connector comprising:

an insulative housing forming a tongue portion extending along a front-to-back direction;

a plurality of first contacts having corresponding first contacting portions;

a plurality of second contacts having corresponding second contacting portions;

a metallic shielding plate located between said first contacting portions and said second contacting portions in a vertical direction, said first contacts, said second contacts and said shielding plate being integrally formed within said insulative housing via an initial insert-molding process to form a contact module;

rear ends of the first contacts configured to be detachably connected to a first primary belting, and front ends of the first contacts configured to be detachably connected to a secondary belting both for controlling positions of said first contacts during said initial insert-molding process, some of said first contacts further configured to be detachably connected to first transverse linkages with corresponding neighboring first contacts;

rear ends of the second contacts configured to be detachably connected to a second primary belting, some of said second contacts further configured to be detachably connected to second transverse linkages with corresponding neighboring second contacts; wherein said housing forming a plurality of spaces therein to allow removal of said first transverse linkages from the corresponding first contacts and removal of said second transverse linkages from the corresponding second contacts in the vertical direction to form a complete contact module before an insulative module is further applied upon the housing via a successive insert-molding process;

wherein no secondary belting is connected to front ends of the second contacts and all second contacts are equipped with the corresponding transverse second linkages.

15. The electrical connector as claimed in claim 14, wherein said secondary belting and both said first primary belting and said second primary belting are adapted to be removed from the corresponding first contacts and second contacts before the insulative module is applied upon the housing.

16. The electrical connector as claimed in claim 14, wherein the insulative module fills the spaces via another insert-molding process.

17. The electrical connector as claimed in claim 14, wherein the first contacts have bending portion around corresponding front portions, and said bending portions of some first contacts are offset from those of the remaining first contacts in a front-to-back direction, and there are secondary beltings of which one is connected to said some first contacts and the other is connected to the remaining first contacts.

18. The electrical connector as claimed in claim 14, wherein the front ends of said first contacts are exposed to an exterior beyond a front edge of the insulative housing after the initial insert-molding process while are embedded within the insulative module after the successive insert-molding process.

* * * * *